US006929390B2

(12) United States Patent
Amano

(10) Patent No.: US 6,929,390 B2
(45) Date of Patent: Aug. 16, 2005

(54) VEHICULAR LAMP

(75) Inventor: Yasuyuki Amano, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 96 days.

(21) Appl. No.: 10/615,821

(22) Filed: Jul. 9, 2003

(65) Prior Publication Data

US 2004/0012976 A1 Jan. 22, 2004

(30) Foreign Application Priority Data

Jul. 15, 2002 (JP) ..... 2002-205295

(51) Int. Cl.[7] ..... F21V 13/04; F21S 8/10

(52) U.S. Cl. ..... 362/545; 362/245; 362/246; 362/511

(58) Field of Search ..... 362/244–246, 362/511, 543–545, 551, 555, 558, 560

(56) References Cited

U.S. PATENT DOCUMENTS 4,883,333 A * 11/1989 Yanez ..... 362/551
5,453,855 A 9/1995 Nakamura et al. ..... 349/58
5,463,534 A * 10/1995 Raven ..... 362/555
5,764,828 A * 6/1998 Iga et al. ..... 385/36
6,520,666 B1 * 2/2003 Beyerlein et al. ..... 362/511
6,527,411 B1 * 3/2003 Sayers ..... 362/245
2002/0136027 A1 * 9/2002 Hansler et al. ..... 362/555

FOREIGN PATENT DOCUMENTS

DE 196 38 081 3/1998

* cited by examiner

*Primary Examiner*—Alan Cariaso
(74) *Attorney, Agent, or Firm*—Koda & Androlia

(57) ABSTRACT

A vehicular lamp with an LED light source in which the translucent member includes a pillar-shaped portion that has at its rear end a condenser lens portion and at its front end a substantially bowl-configured parallel translation controlling portion. Light from the LED light source is formed into parallel light fluxes by the condenser lens portion, and this parallel light fluxes strike the pillar-shaped portion, and then the light path of the parallel light fluxes is formed into a crank configuration in a direction in which the light path separates from the axis of the pillar-shaped portion, thus allowing the reflected light from the parallel translation controlling portion to be resulted in parallel light fluxes that travels toward the front of the lamp and allowing the translucent member to appear to be lit uniformly.

12 Claims, 9 Drawing Sheets

VEHICULAR LAMP

BACKGROUND OF THE INVENTION

1. Field of the Invention

The present invention relates to a vehicle lamp that has an LED (Light Emitting Diode) light source.

2. Prior Art

Recently, vehicle lamps with an LED light source have been frequently employed. In the vehicle lamp disclosed in Japanese Utility-Model Application Laid-Open (Kokai) No. 61-153201, a translucent member is placed in the vicinity of the front of an LED light source disposed so as to face in the forward direction of the lamp, and light from the LED light source is internally reflected plurality of times by this translucent member and emitted toward the front of the lamp.

With an adoption of such a lamp structure, it is possible to allow the light from the LED light source to appear to be lit over a large light emitting area.

However, in the above-described vehicular lamp, the light from the LED light source reaches the translucent member as scattered light, and the angles of the incident light on the final reflecting surface of the translucent member vary at the respective sites on the final reflecting surface. This causes a problem. When the translucent member is observed from the front of the lamp when the LED light source is lit, the appearance of a uniform shining of the translucent member is not easily provided.

In order to achieve this uniform shining, the positional relationship between the LED light source and the final reflecting surface of the translucent member needs to be precisely defined. This causes another problem. The configuration of the translucent member is extremely limited.

SUMMARY OF THE INVENTION

The present invention is made in view of such circumstances of the prior art.

It is an object of the present invention to provide a vehicular lamp that has an LED light source and a translucent member, in which the translucent member appears to be lit uniformly when the LED light source, when it is lit, is observed from the front of the lamp and in which the lamp has an increased freedom of design choice with respect to the shape of the translucent member.

The present invention achieves the above-described object by way of improving the shape of the translucent member.

More specifically, the above object is accomplished by a unique structure of the present invention for a vehicular lamp that comprises: an LED light source disposed so as to face in the forward direction of the lamp, and a translucent member provided in the vicinity of the front of the LED light source and configured to allow the light from the LED light source to undergo internal reflection plurality of times so as to be emitted toward the front of the lamp; and in the present invention, the translucent member is comprised of:

- a pillar-shaped portion that extends in a longitudinal (front-to-rear) direction of the lamp,
- a condenser lens portion provided in a rear-end of said pillar-shaped portion so as to allow light from the LED light source to enter into the pillar-shaped portion and form such light from the LED light source into parallel light fluxes that travel toward the front of the lamp; and

- at least one parallel translation controlling portion formed so as to extend in a direction sloping from the front-end of the pillar-shaped portion at a predetermined angle with respect to the axis of the pillar-shaped portion so that the parallel translation controlling portion translates the light path of the parallel light fluxes reaching the pillar-shaped portion to form a crank configuration in the direction in which the light path separates from the axis of the pillar-shaped portion In the above-described structure, the "vehicular lamp" is not limited to a particular type of vehicular lamp, and it can be a tail lamp, a stop lamp or the like.

The material of the "translucent member" is not limited as long as it has translucent properties. The translucent member can be made of a transparent synthetic resin, a translucent member formed of glass, or the like.

The specific structure of the "pillar-shaped portion", e.g., a cross-sectional shape, a length, and the like, is not specially limited, and it can be formed in a circularly cylindrical configuration, a polygonally cylindrical configuration, or the like.

The specific structure of the "condenser lens portion" is not specially limited as long as the condenser lens is capable of forming the light from the LED light source into parallel light fluxes. Thus, the condenser lens portion can be in a Fresnel lens configuration or a planoconvex lens configuration, for example.

As to the "parallel translation controlling portion," as long as it extends in a direction sloping from the front-end of the pillar-shaped portion at a predetermined angle with respect to the axis of the pillar-shaped portion, and it translates the light path of the parallel light fluxes reaching the pillar-shaped portion to form a crank configuration in a direction in which the light path is separating from the axis of the pillar-shaped portion, the specific structure thereof, e.g. the number of controlling portion formed and the like, is not specially limited.

It is needless to say that the concept of the "parallel translation in a crank configuration" includes the form of translating the light to be bent at right angles, but this concept also includes the form of translating the light to be bent at any angle other than the right angles. Further, the concept of the "parallel translation in a crank configuration" includes not only the form of parallel translation just a single time in a crank configuration, but also the form of parallel translation plurality of times in a crank configuration.

The "predetermined angle" is any value less than 90 degrees, and it is not limited to a specific angle. However, the predetermined angle is preferably set at a value which is equal to or less than substantially 45 degrees from the point of view of increasing the internal reflection efficiency.

As seen from the above, in the vehicular lamp of the present invention, a translucent member is provided in the vicinity of the front of an LED light source which is disposed so as to face in the forward direction of the lamp, and the light from the LED light source is internally reflected plurality of times by the translucent member so as to be emitted toward the front of the lamp. Furthermore, in this structure, the translucent member includes: a pillar-shaped portion that extends in the longitudinal direction of the lamp; a condenser lens portion which is formed at a rear-end of the pillar-configuration portion and allows light from the LED light to enter into the pillar-shaped portion and forms the LED light into parallel light fluxes which travels in the forward direction of the lamp; and at least one parallel translation controlling portion that extends in a direction sloping from the front-end of the pillar-shaped portion at a predetermined angle with respect to the axis of the pillar-shaped portion so that it translates the light path of the parallel light flux reaching the pillar-shaped portion to form a crank configuration in a direction in which the light path is separating from the axis of the pillar-shaped portion. The structure above of the present invention provides several advantages as described below.

First, when the translucent portion is observed from the front of the lamp when the LED light source is lit, the translucent member gives an appearance that the front-end of the parallel translation controlling portion, which is located at a distance from the axis with respect to the pillar-shaped portion, is lit. As a result, light from the LED light source can appear to be lit over a large illuminated area.

Since the light reflected from the final reflecting surface of the parallel translation controlling portion results in parallel light fluxes that travel in the forward direction of the lamp. This easily makes the translucent member appear to be lit uniformly when it is observed from the front of the lamp.

In addition, the light from the LED light source is formed into parallel light fluxes that travel toward the front of the lamp in the pillar-shaped portion. Thus, the above effects are obtained irrespective of the length of the pillar-shaped portion. In consequence, it is possible to selectively set the length of the pillar-shaped portion, and this increases the freedom of design choice with respect to the shape of the translucent member.

As seen from the above, according to the present invention, in a vehicular lamp that has an LED light source and a translucent portion, the translucent member appears to be lit uniformly when it is observed from the front of the lamp when the LED light source is lit, and the freedom of design choice with respect to the shape of the translucent member is increased.

As described above, the specific structure of the "parallel translation controlling portion" is not specifically limited, and it can be formed in a substantial bowl-shape so as to surround the axis of the pillar-shaped portion. In this structure, it is possible to make the front-end of the parallel translation controlling portion appear to emit light over a large substantially ring-shaped illuminated area when the translucent member is observed from the front of the lamp when the LED light source is lit.

The light emitted in the forward direction of the lamp from the translucent member finally is emitted from the front-end of the parallel translation controlling portion. The "front-end" can be configured as a simple flat plane, but it can be structured such that at least one diffusing lens element, which allows the parallel light fluxes reaching the front-end to be emitted diffusely in the forward direction of the lamp, is formed. In this structure, the front-end of the parallel translation controlling portion can appear, when observed from the front of the lamp with the LED light source lit, to be lit not only directly from the front of the lamp but also from a direction shifted some degrees away directly from the front.

In the above structure, a part of the front-end of the pillar-shaped portion can be formed as a light-emitting face that allows the parallel light fluxes reaching the pillar-shaped portion to be emitted toward the front of the lamp. In this structure, the translucent member can appear to be lit not only at the front-end of the parallel translation controlling portion but also at the front-end of the pillar-shaped portion, which consequently makes an illumination effect with a sense of depth possible. Though this "light-emitting face" is a simple flat plane, it can be configured as a diffusing lens face, resulting in that the light-emitting face, when observed from the front of the lamp when the LED light source is lit, can appear to be lit not only directly from the front of the lamp but also from any direction shifted some degrees directly from the front.

The vehicular lamp according to the present invention can include only one set of an LED light source and a translucent member or a plurality of sets of LED light sources and translucent members. In the event that a plurality of sets of LED light sources and translucent members are provided at a plurality of locations, a further increase in brightness of the vehicular lamp is attained. In the present invention, the length of the pillar-shaped portion of the translucent portion can be selectively set, and this easily makes it possible to arrange the plurality of LED light sources and translucent members in a desired layout in accordance with the lamp shape and the like.

DETAILED DESCRIPTION OF THE INVENTION

Hereafter, one embodiment according to the present invention will be described with reference to the accompanying drawings.

Figure 1:
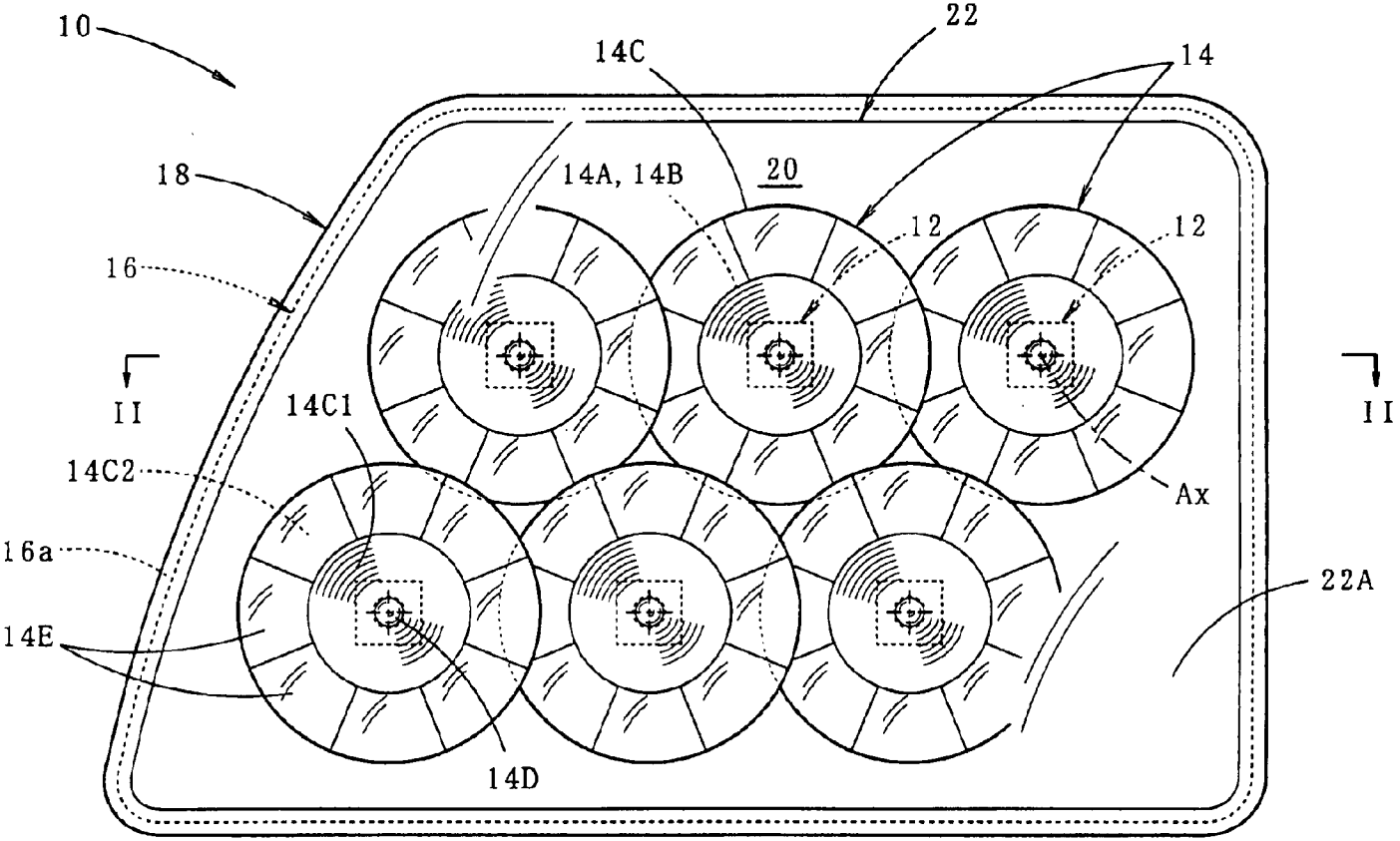
FIG. 1 is a front elevational view of the vehicular lamp according to one embodiment of the present invention.
Figure 2:
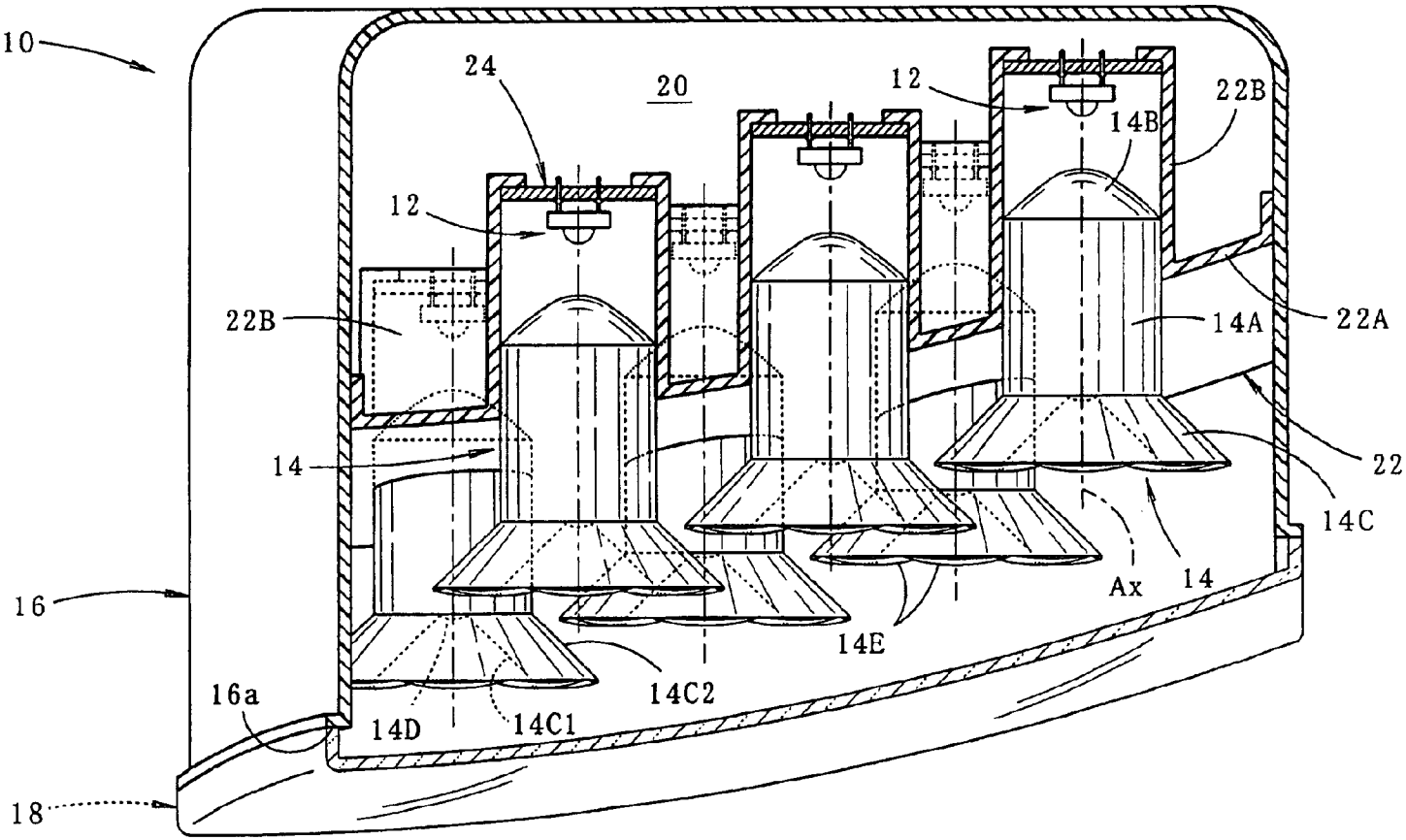
FIG. 2 is a sectional view taken along the line II—II in FIG. 1.

As illustrated in FIGS. 1 and 2, the vehicular lamp 10 of the shown embodiment is a tail lamp provided on the right rear-end portion of a vehicle, and it has a plurality of sets (six sets) of LED light sources 12 and translucent members 14 housed in a lamp chamber 20 constituted by a lamp body 16 and a plain-configured translucent cover 18 which is attached to a front-end opening 16*a* of the lamp body 16 (the "front-end opening 16*a* of the lamp body 16" being a "rear-end opening" for the vehicle).

The lamp chamber 20 incorporates a supporting member 22 which supports the plurality of sets of LED light sources 12 and translucent members 14. The supporting member 22 includes a panel portion 22A, which is formed so as to substantially follow the curved shape of the translucent cover 18, and cylindrical portions 22B, which protrude backward (of the lamp body 16) from a plurality of locations (six locations) on the panel portion 22A Each one of the LED light sources 12 is disposed so as to face in the forward direction of the lamp. Each LED light source 12 is supported by an individual substrate 24 and fixed to a rear-end of each one of the cylindrical portions 22B of the supporting member 22.

Each translucent member 14 is a transparent synthetic resin molding (e.g. an acrylic resin molding) that includes a pillar-shaped portion 14A extending in the longitudinal direction, a condenser lens portion 14B formed in the rear end portion of the pillar-shaped portion 14A, and a parallel translation controlling portion 14C formed in the front end portion of the pillar-shaped portion 14A. The pillar-shaped portion 14A is inserted into the cylindrical portion 22B of the supporting member 16 from the front side to around midway and secured in the cylindrical portion 22B.

Each one of the sets of LED light sources 12 and translucent members 14 has the same structure and is supported by the cylindrical portion 22B of the supporting member 16 with each of the LED light sources 12 placed on the axis Ax of the pillar-shaped portion 14A of the corresponding translucent member 14.

Figure 3:
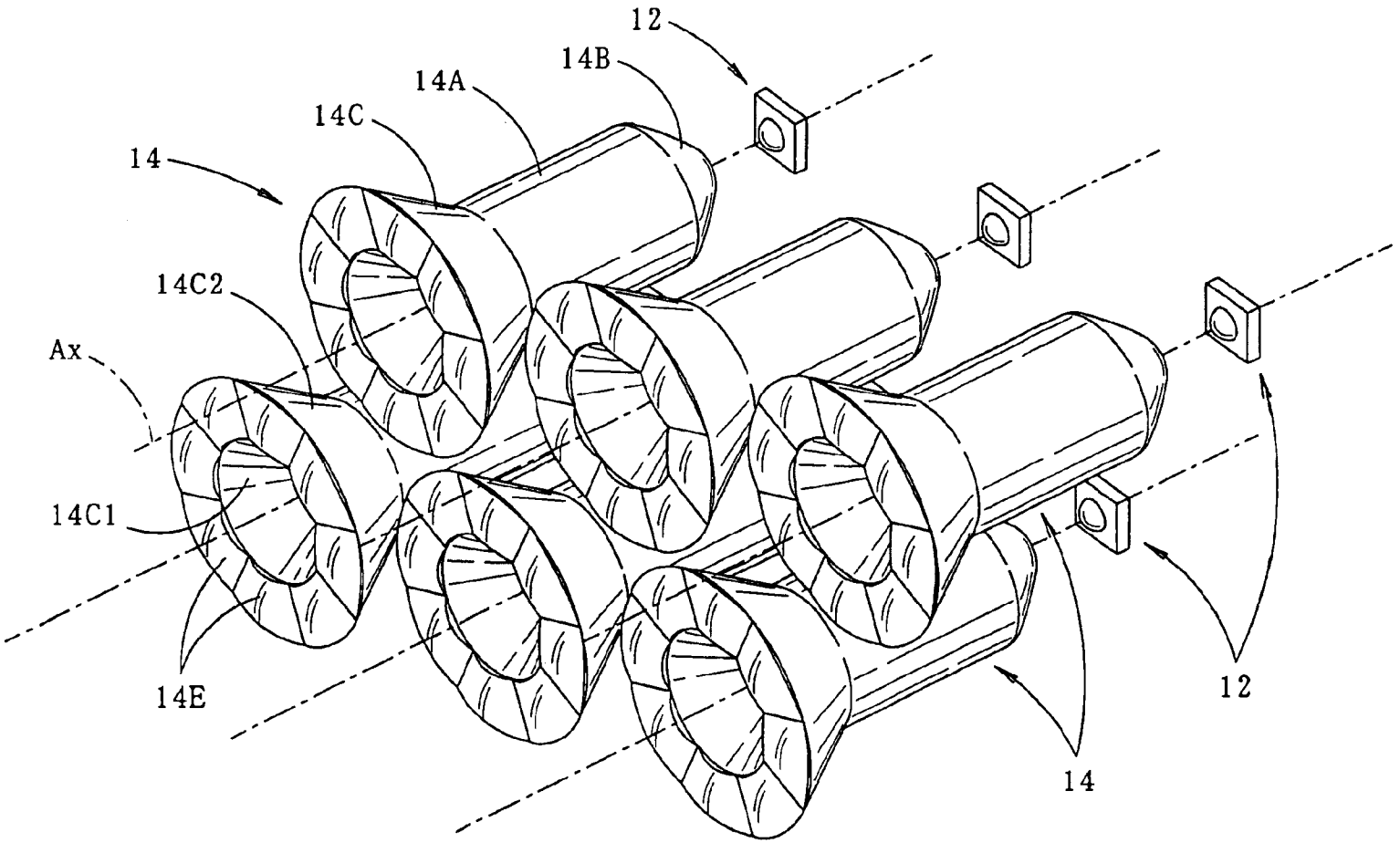
FIG. 3 is a perspective view of a plurality of sets of LED light sources and translucent members used in the vehicular lamp.

FIG. 3 illustrates the above-described plurality of sets of LED light sources 12 and translucent members 14.

As seen from FIG. 3, the plurality of sets of LED light sources 12 and translucent members 14 are arranged in two levels, upper and lower, and the three sets in each level are arranged at regular intervals in the right-left direction of the lamp.

Here, each set of LED light sources 12 and translucent members 14 is placed so as to substantially follow the curved shape of the translucent cover 18. Specifically, three of the translucent members 14 which are situated in each of the upper and lower levels are arranged such that as translucent members 14 are positioned toward the outer side in the vehicle-width direction, they are displaced toward the back step by step. Further, the three translucent members 14 situated in the upper level are arranged so as to be displaced further toward the back than the positions of the three translucent members 14 situated in the lower level.

Figure 4:
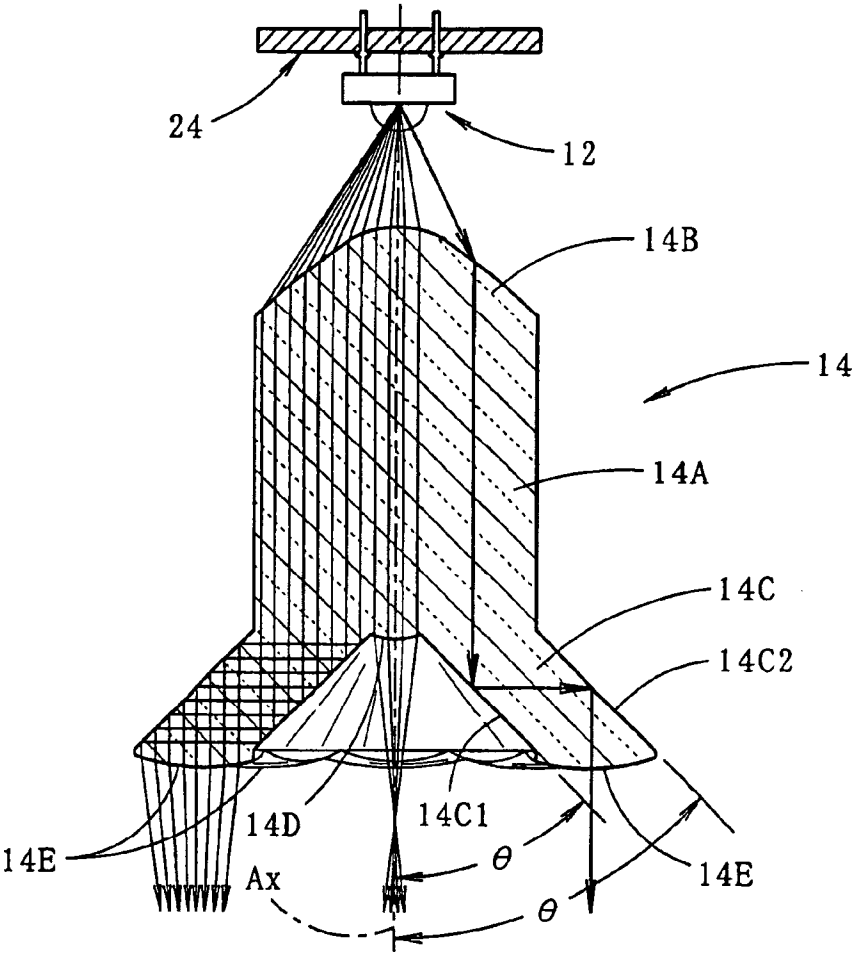
FIG. 4 is a horizontal cross-sectional view of one set of the LED light source and translucent member.

FIG. 4 shows one set of the LED light source 12 and translucent member 14.

As shown FIG. 4. the translucent member 14 is formed in an substantially mushroom configuration and structured such that light from the LED light source 12 (hereinafter referred to as an "LED-emitted light") undergoes internal reflection plurality of times (twice) and then is emitted in the forward direction of the lamp. In other words, the translucent member 14 forms the light from the LED light source 12 into parallel light fluxes, which are to travel in the forward direction of the lamp, in the condenser lens portion 14B, then it allows the parallel light fluxes to strike the pillar-configuration portion 14A, translates the light path of the parallel light fluxes, which have passed through the pillar-shaped portion 14A, to form a crank configuration in a direction such that the light path is separating from the axis Ax in the parallel translation controlling portion 14C, and finally expels the resultant light from the front face of the parallel translation controlling portion 14C in the forward direction of the lamp.

The pillar-shaped portion 14A is formed in a cylindrical configuration, the condenser lens portion 14B is formed in a single convex lens configuration, and the parallel translation controlling portion 14C is formed in a substantial bowl-shape.

The area in the immediate vicinity of the axis Ax on the front-end of the pillar-shaped portion 14A has a light-emitting face 14D that allows the parallel light fluxes reaching the front-end to be emitted toward the front of the lamp. The light-emitting face 14D is formed in a convex lens configuration in order to form the light emitted from the light-emitting face 14D into diffuse light.

The parallel translation controlling portion 14C has a conical-configured inner peripheral surface 14C1 and a conical-configured outer peripheral surface 14C2, each of them being part of a conical surface that has a vertical angle of 90 degrees and extends in a direction inclining at an angle θ (θ=45 degrees) with respect to the axis Ax of the pillar-shaped portion 14A (in a forward slanting direction). On the front-end of the parallel translation controlling portion 14C, a plurality (eight) of diffusing lens elements 14E are formed. The diffusing lens elements 14E allow the parallel light fluxes reaching the front-end to be emitted diffusely in the forward direction of the lamp. Such lens elements 14E are each formed in a convex lens configuration and are arranged at regular intervals in the circumferential direction.

As shown in FIG. 1, when viewed from the front of the lamp, the individual sets of LED light sources 12 and translucent members 14 are arranged such that the parallel translation controlling portions 14C of the translucent members 14 partly overlap one another. However, as described above, each of the translucent members 14 has an approximate mushroom shape, and such translucent members 14 are arranged such that the three translucent members 14 provided in the upper level are shifted some degrees from the three translucent members 14 provided in the lower level in the longitudinal direction of the lamp, and also the upper and lower levels are shifted some degrees from each other in the longitudinal direction. Thus, interference does not occur between the translucent members 14.

Figure 5:
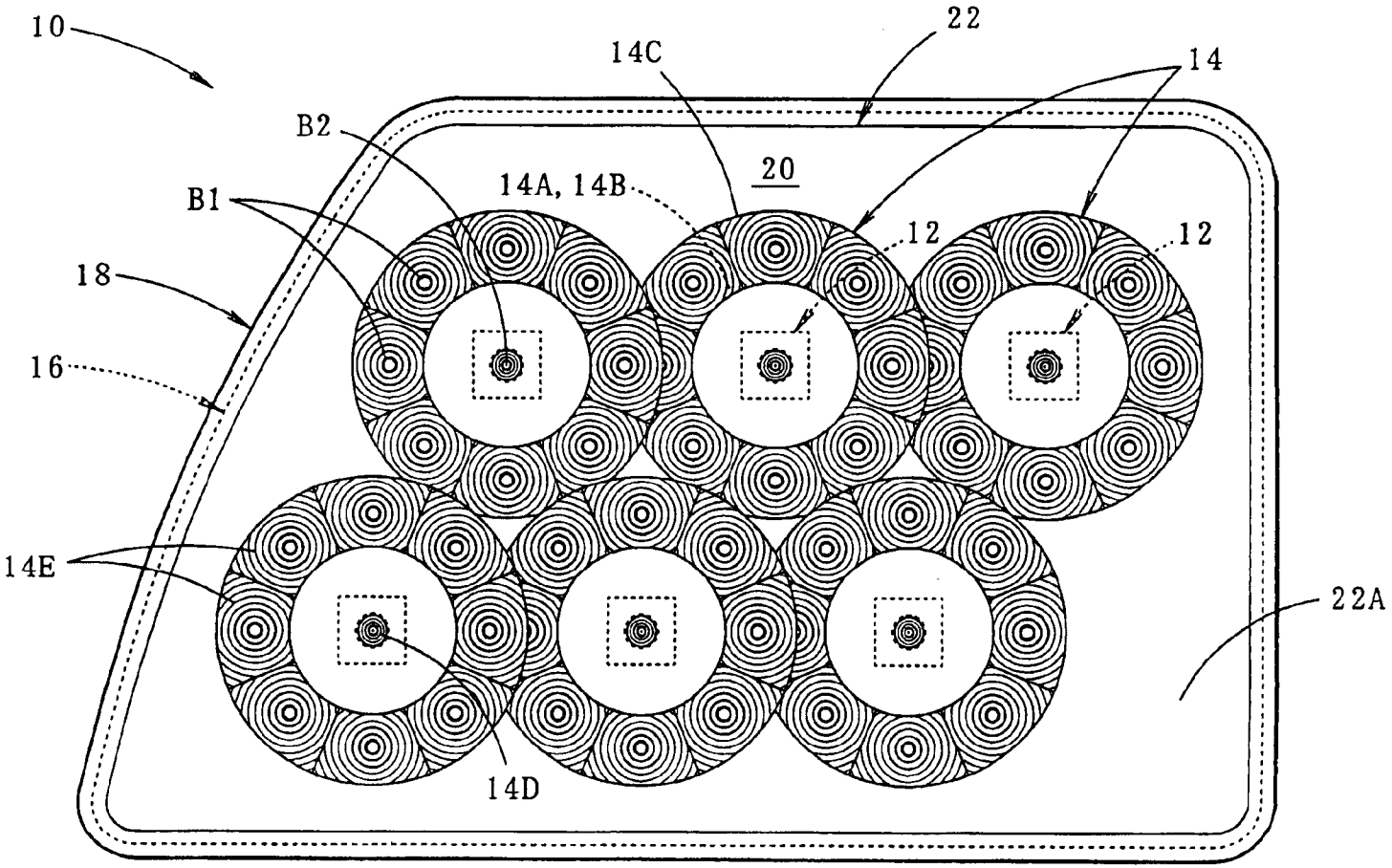
FIG. 5 is a front elevational view of the vehicular lamp when the LED light sources are lit.

FIG. 5 shows the vehicular lamp 10 of the above embodiment when the LED light sources 12 are lit.

As seen from FIG. 5, when the vehicular lamp 10 is observed directly from the front, each of the translucent members 14 gives such an appearance that the plurality of diffusing lens elements 14E on the front-ends of the parallel translation controlling portions 14C, and the light-emitting faces 14D on the front-ends of the pillar-shaped portions 14A are lit to form lightening portions B1 and B2. At the same time, each of the diffusing lens elements 14E and the light-emitting faces 14D is formed in a convex lens configuration, and also the LED-emitted light is incident as parallel light fluxes on each of the diffusing lens elements 14E and the light-emitting faces 14D. Accordingly, the central portion of each one of the diffusing lens elements 14E and the light-emitting faces 14D appears to be lit particularly brightly, and also the portion around the central portion appears to be lit to some extent due to stray light included in the above-described parallel light fluxes.

Even when the angle of vision is shifted to some degree directly from the front of the lamp, the diffusing lens elements 14E and light-emitting face 14D appear to be lit most brightly at a portion that is off the central portion thereof depending upon the degree of shifting of the angle of vision. This is because the LED-emitted light is incident as approximate parallel light fluxes on each of the diffusing lens elements 14E and light-emitting face 14D.

As described above in detail, in the vehicular lamp 10 of the shown embodiment, a translucent member 14 is provided in the vicinity of the front of an LED light source 12 that faces the front of the lamp, and light from the LED light source 12 is internally reflected plurality of times by the translucent member 14 so as to be emitted in the forward direction of the lamp. In this structure, the translucent member 14 is comprised of: a pillar-shaped portion 14A that extends in the longitudinal direction; a condenser lens portion 14B that is provided in the rear-end of the pillar-shaped portion 14A so as to form the light from the LED light source 12 into parallel light fluxes which travel in the forward direction of the lamp and then allows the resulting light to strike the pillar-shaped portion 14A; and a substantially bowl-configured parallel translation controlling portion 14C that extends in a direction sloping from the front-end of the pillar-shaped portion 14A at a predetermined angle θ with respect to the axis Ax of the pillar-shaped portion 14A so that the light path of the parallel light fluxes reaching the pillar-shaped portion 14A is translated to form a crank configuration in such a direction that the light path separates from the axis Ax of the pillar-shaped portion 14A. Because of this structure, the vehicular lamp 10 has such advantages as described below.

When the translucent member 14 is observed from the front of the lamp when the LED light source 12 is lit, the translucent member 14 gives an appearance that the front-end of the parallel translation controlling portion 14C located at a distance from the axis Ax with respect to the pillar-shaped portion 14A is shining. Thus, the LED light source 12 appears to be lit over a large illuminated area.

The reflected light from the conical-configured outer peripheral surface 14C2, serving as the final reflecting face, of the parallel translation controlling portion 14C results in parallel light fluxes travelling toward the front of the lamp. This easily makes the translucent member 14 (to be precise, the front-end of the parallel translation controlling portion 14C) appear to be lit uniformly when it is observed from the front of the lamp.

In addition, inside the pillar-shaped portion 14A, light from the LED light source 12 is formed into parallel light fluxes travelling toward the front of the lamp. Thus the above effects are obtained regardless of the length of the pillar-shaped portion 14A. In consequence, the length of the pillar-shaped portion 14A can be selectively set, thus increasing the freedom of design choice with respect to the shape of the translucent member 14.

As seen from the above, according to the shown embodiment, the translucent member 14 appears to be lit uniformly when the vehicular lamp 10 is observed from the front of the lamp when the LED light source 12 is lit, and the freedom of design choice with respect to the shape of the translucent member 14 can be increased.

In the embodiment, particularly, the conical-configured inner peripheral surface 14C1 and the conical-configured outer peripheral surface 14C2 that form the parallel translation controlling portion 14C extend in a direction sloping at an angle θ (θ=45 degrees) with respect to the axis Ax of the pillar-shaped portion 14A. Accordingly, the parallel light fluxes strike the conical-configured inner peripheral surface 14C1 and the conical-configured outer peripheral surface 14C2 at an incident angle equal to or less than a critical angle. As a result, the light reaching the translucent member 14 after leaving the LED light source 12 is totally reflected and then emitted efficiently from the front-end of the parallel translation controlling portion 14C in the forward direction.

In addition, in the shown embodiment, the parallel translation controlling portion 14C is formed in substantially a bowl-shape so as to surround the axis Ax of the pillar-shaped portion 14A. Thus, the translucent member 14 appears to be lit over a large substantially ring-shaped illuminated area when observed from the front of the lamp when the LED light source 12 is lit.

Further, in the embodiment, the plurality of diffusing lens elements 14E are formed on the front-end of the parallel translation controlling portion 14C and allow the parallel light fluxes reaching the front-end to be emitted diffusely in the forward direction of the lamp. Accordingly, the front-end of the parallel translation controlling portion 14C, when the translucent portion 14 is observed from the front of the lamp when the LED light source 12 is lit, appears to be lit not only from directly the front of the lamp but also from a direction shifted some degrees away from directly the front of the lamp.

Still further, the area in the vicinity of the axis Ax on the front-end of the pillar-shaped portion 14A is the light-emitting face 14D that allows the parallel light fluxes reaching the front-end to be emitted toward the front of the lamp. Thus, the translucent member 14 appears to be lit not only at the front-end of the parallel translation controlling portion 14C but also at the front-end of the pillar-shaped portion 14A, which consequently makes an illumination effect with a sense of depth possible. Since the light-emitting face 14D has a convex lens configuration, the light-emitting face 14D, when observed from the front of the lamp when the LED light source is lit, appears to be lit not only directly from the front of the lamp but also from any direction shifted directly from the front of the lamp.

In the shown embodiment, a plurality of sets of LED light sources 12 and translucent members 14 are provided, and each of the translucent members 14 is formed in an approximate mushroom configuration. Due to this configuration, the parallel translation controlling portions 14C of the respective translucent members 14 are arranged so as to partly overlap each other when viewed from the front of the lamp. Nevertheless, it is possible to prevent occurrence of interference between the translucent members 14 by disposing the parallel translation controlling portions 14C displaced from each other as appropriate in the longitudinal direction. Thus, the plurality of sets of LED light sources 12 and translucent members 14 can be easily arranged in a desired layout in accordance with the lamp shape and the like.

Next, a first modification of the above-described embodiment will be described.

Figure 6:
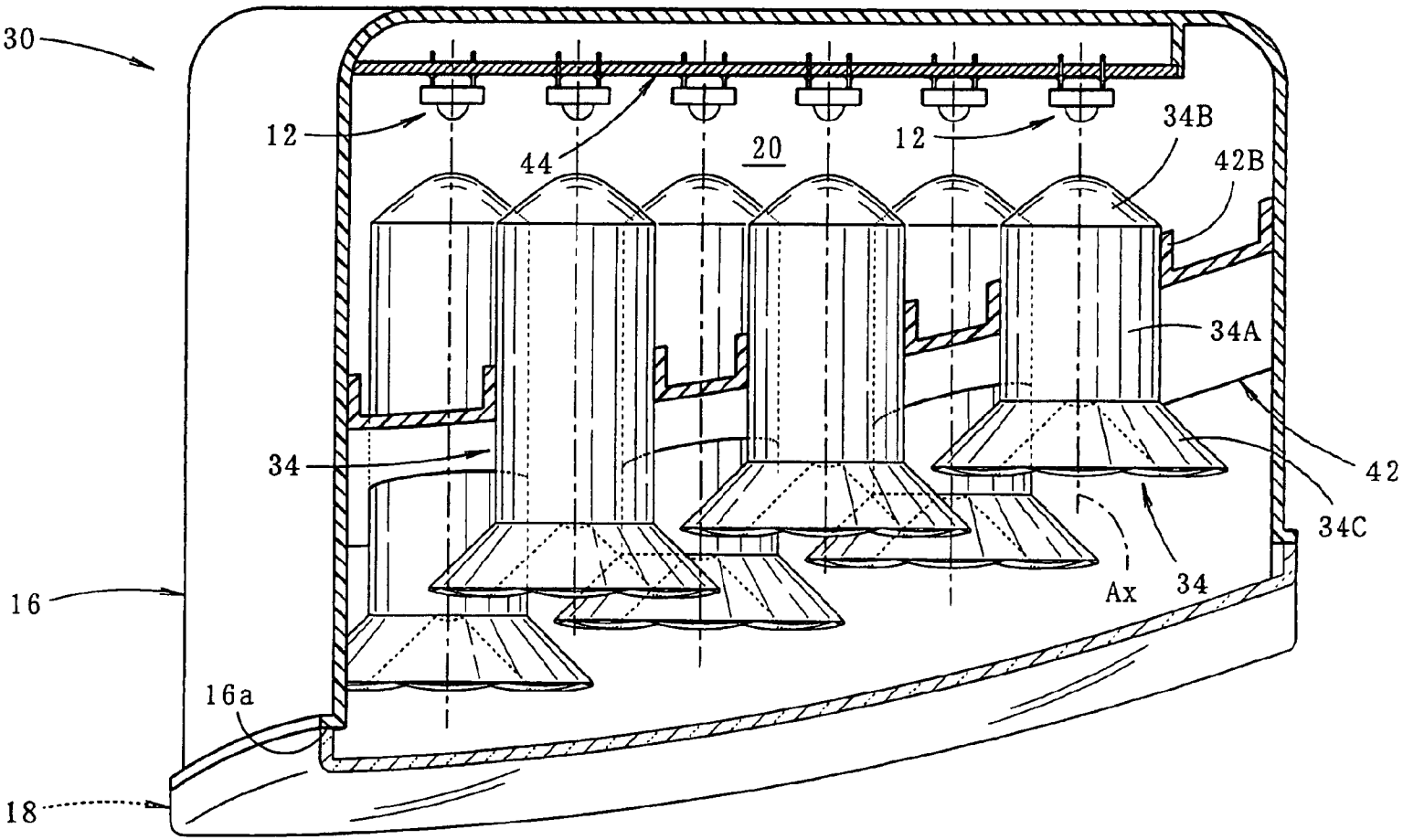
FIG. 6 shows, in a similar way to FIG. 2, a vehicular lamp according to a first modification of the embodiment.

FIG. 6 shows in a similar way to FIG. 2 the vehicular lamp 30 of the first modification.

As seen from FIG. 6, the vehicular lamp 30 has translucent members 34 each differing in structure from that of the vehicular lamp 10 of the above-described embodiment.

In particular, each one of the translucent members 34 is comprised of a pillar-shaped portion 34A, a condenser lens portion 34B and a parallel translation controlling portion 34C. In this respect, the translucent member 34 of the first modification is the same as the translucent member 14 of the foregoing embodiment; however, the lengths of the individual pillar-shaped portions 34A are set at values differ from one translucent member 34 to another.

More specifically, the translucent members 34 that have the parallel translation controlling portion 34C located in a relatively further forward position have the pillar-shaped portions 34A that have the length of a larger value. The length of the pillar-shaped portion 34A of each translucent member 34 is set so that the positions of the condenser lens portions 34B of the translucent members 34 are aligned with that of the other condenser lens portions 34B in the longitudinal direction. Each LED light source 12 that corresponds to the respective translucent members 34 is secured to the lamp body 16 through a single common substrate 44. Further, the cylindrical portions 42B of the supporting member 42 that support the plurality of translucent members 34 have the length set at a value smaller than that of the cylindrical portions 22B of the supporting member 22 of the foregoing embodiment.

With the structure of the first modification, the same effects as those in the foregoing embodiment are obtained. Moreover, in this first modification, since the plurality of the LED light sources 12 are supported by a single substrate 44, the lamp structure is simple.

Next, a second modification of the foregoing embodiment will be described.

Figure 7:
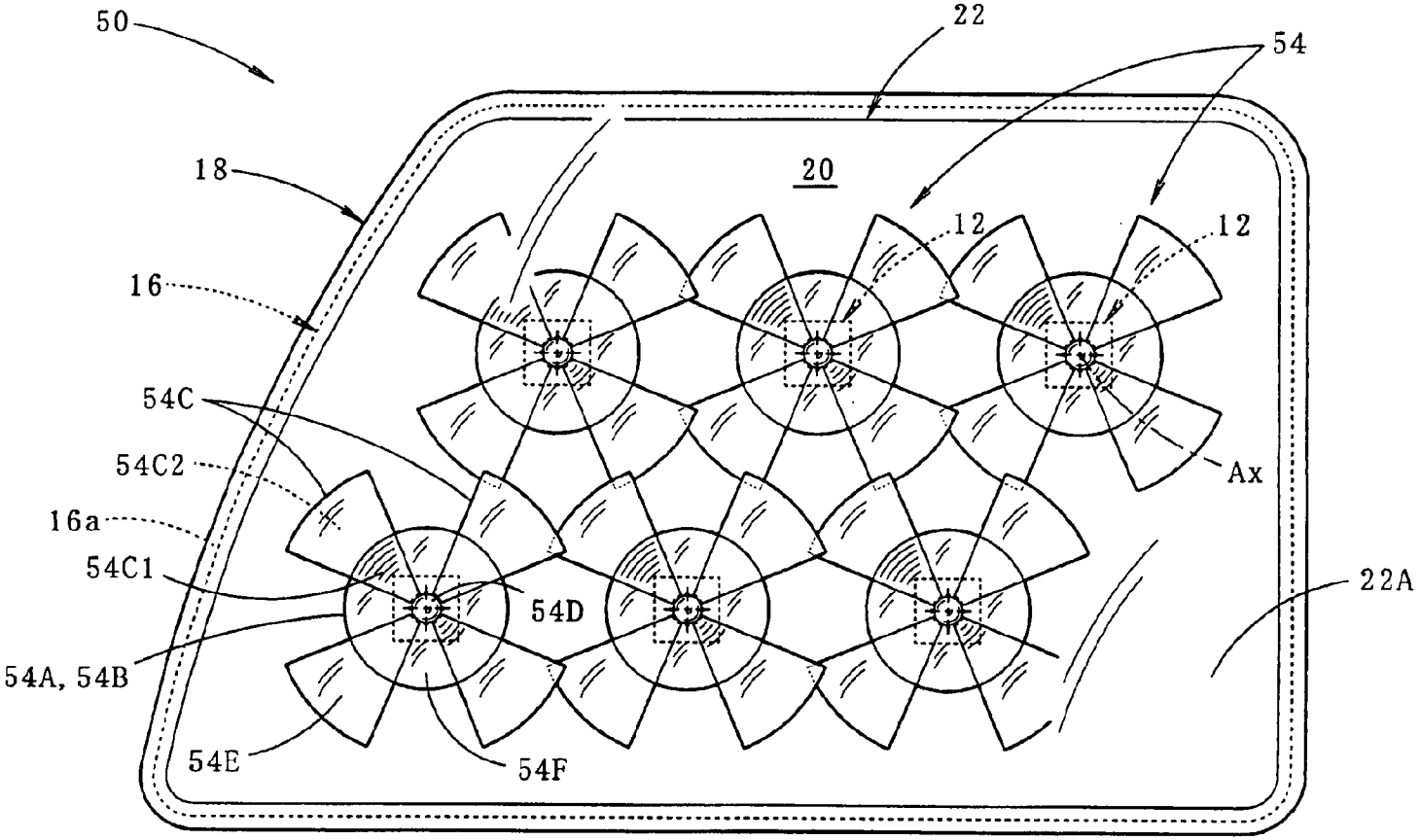
FIG. 7 is a front elevational view of a vehicular lamp according to a second modification of the embodiment.
Figure 8:
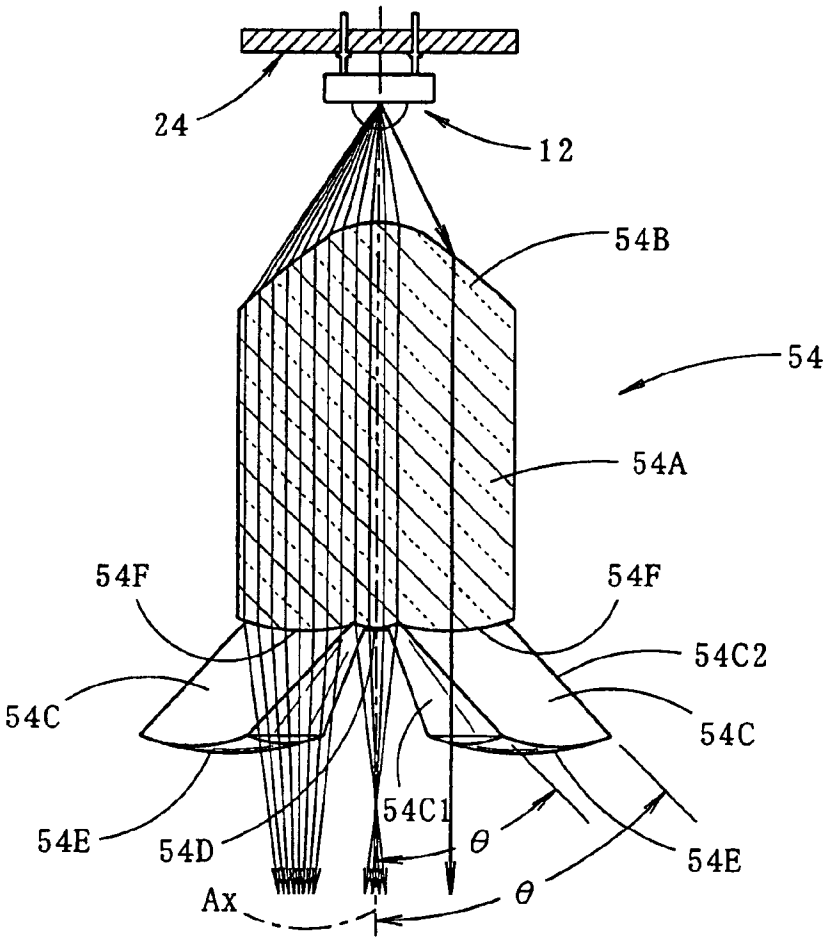
FIG. 8 is a horizontal cross-sectional view of an LED light source and a translucent member according to the second modification of the embodiment.

FIG. 7 is a front elevational view of the vehicular lamp 50 of the second modification. FIG. 8 shows, in a similar manner to FIG. 3, one set of the LED light source 12 and translucent members 54 that constitutes the vehicular lamp 50.

As seen from FIGS. 7 and 8, the vehicular lamp 50 has translucent members 54 each differing in structure from that of the vehicular lamp 10 of the above-described embodiment.

More specifically, each translucent member 54 is comprised of a pillar-shaped portion 54A, a condenser lens portion 54B and a parallel translation controlling portion 54C. In this respect the translucent member 54 of the second modification is the same as the translucent member 14 of the foregoing embodiment; however, the parallel translation controlling portion 54C differs in structure from that of the above embodiment.

The parallel translation controlling portion 54C of each translucent member 54 is not formed in substantially a bowl-shape as in the case of the parallel translation controlling portion 14C of the foregoing embodiment, and the controlling portion 54C of the second modification is formed at four locations at regular intervals in the circumferential direction. A conical-configured inner peripheral face 54C1 and a conical-configured outer peripheral face 54C2 which form the parallel translation controlling portion 54 of each translucent member 54 extend in a direction sloping at an angle θ (θ=45 degrees) with respect to the axis Ax of the translucent member 54 as in the case of the foregoing embodiment.

Four locations each being between two parallel translation controlling portions 54C on the front-end of the pillar-shaped portion 54A of the translucent member 54 are formed so as to be light-emitting faces 54F that allow parallel light fluxes reaching the front-end of the pillar-shaped portion 54A to be emitted toward the front of the lamp. Each light-emitting face 54F is formed in a convex lens configuration in order to form the emitted light from the light-emitting face 54F into diffuse light. It should be noted that like the light-emitting face 14D of the foregoing embodiment the area in the vicinity of the axis Ax on the front-end of the pillar-shaped portion 54A is formed so as to be a light-emitting face 54D.

Figure 9:
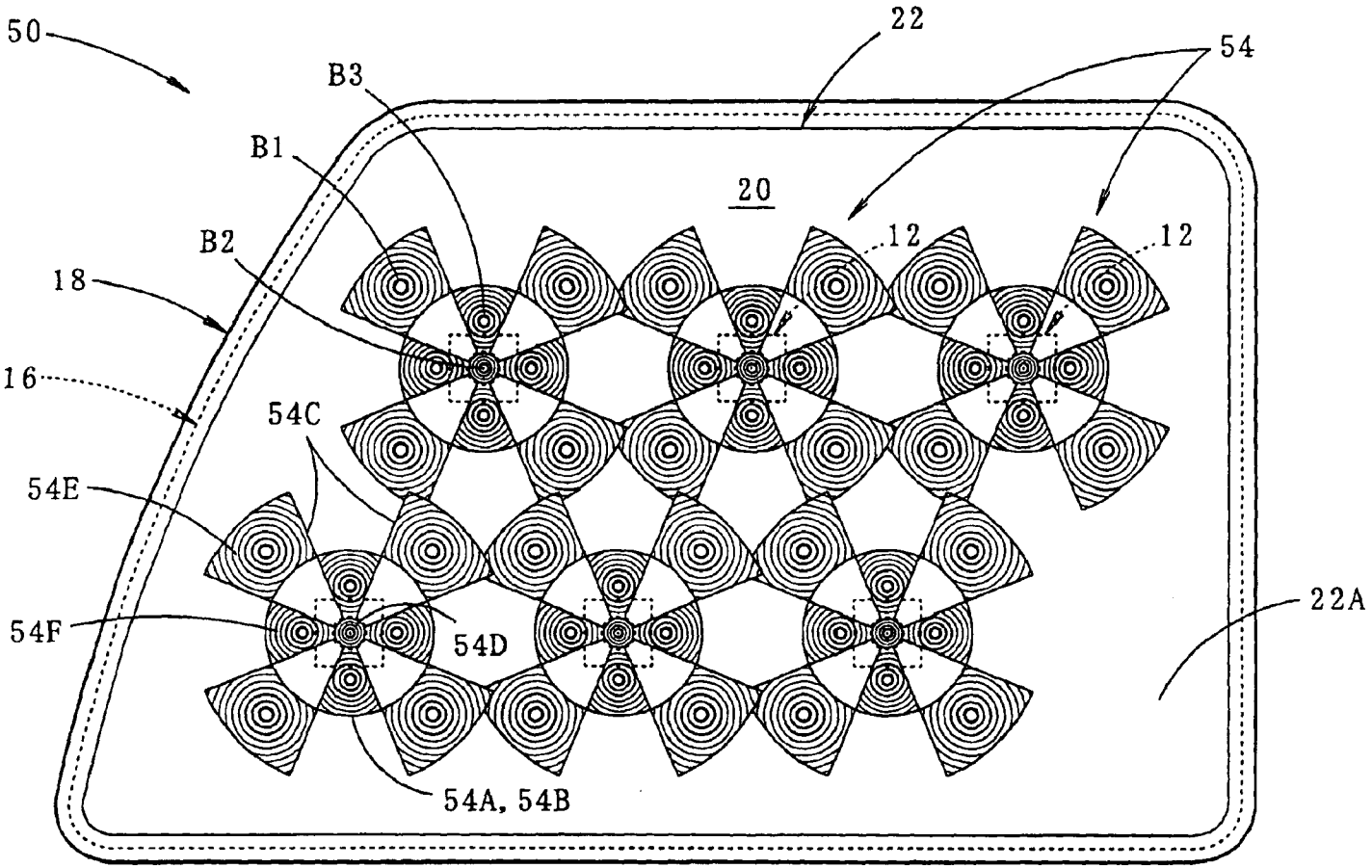
FIG. 9 is a front elevational view of the vehicular lamp of the second modification when the LED light sources are lit.

FIG. 9 shows the vehicular lamp 50 of the second modification with the LED light source 12 lit.

As seen from FIG. 9, when the vehicular lamp 50 is observed from the front, each translucent member 54 gives an appearance that diffusing lens elements 54E, which are formed in the four front-ends of the parallel translation controlling portion 54C, and the light-emitting face 54D and four light-emitting faces 54F, which are formed on the front-end of the pillar-shaped portion 54A, shine so as to form lightening portions B1 and B2 and B3. Each diffusing lens element 54E, the light-emitting face 54D and each light-emitting face 54F respectively have a convex lens configuration; and the LED-emitted light is incident, as parallel light fluxes, on each of the diffusing lens element 54E, the light-emitting face 54D and each light-emitting face 54F. Accordingly, the central portions of each diffusing lens element 54E, the light-emitting face 54D and each light-emitting face 54F appear to be lit particularly brightly, and the portion around each central portion appears to be lit to some extent due to stray light included in the parallel light fluxes.

Even when the angle of vision is shifted to some degree directly from the front of the lamp, the diffusing lens elements 54E, light-emitting face 54D and light-emitting faces 54F appear to be lit most brightly at a portion that is off the central portion thereof depending upon the degree of shifting of the angle of vision. This is because the LED-emitted light is incident as approximate parallel light fluxes on each of the diffusing lens elements 54E, light-emitting face 54D and light-emitting faces 54F.

With the structure of the second modification, the same effects as those in the foregoing embodiment are attained. In this second modification, the light-emission pattern in each of the translucent members 54 is different from that in the foregoing embodiment. Therefore, when the vehicular lamp 50 is observed from the front of the lamp when the LED light source 12 is lit, each of the translucent members 54 appears to be lit uniformly with impressions unlike those given by the vehicular lamp 10 of the foregoing embodiment.

In each one of the foregoing embodiment and modifications, the translucent members 14, 34 and 54 allow the light from the LED light source 12 to be emitted diffusely toward the front of the lamp. Instead of this structure, another structure is possible in which the light from the LED light source 12 is formed into parallel light fluxes and then directly emitted diffusely toward the front of the lamp, and the translucent cover 18 or the like has a diffuse control function.

Further, each one of the foregoing embodiment and modifications is described on the vehicular lamp 10, 30 and 50 which is a tail lamp mounted in the right rear-end portion of a vehicle. However, the same or similar structure as those in the foregoing embodiment and each modification is applicable to such a vehicular lamp as a tail lamp mounted in the left rear-end portion of a vehicle or to another type of vehicular lamps (e.g. a stop lamp, a tail & stop lamp, a clearance lamp, a turn-signal lamp, and the like), and the same or similar effects are obtained.

What is claimed is:

1. A vehicular lamp comprising:

an LED light source disposed so as to face in a forward direction of said lamp, and a translucent member provided in the vicinity of a front of said LED light source and configured to allow light from said LED light source to undergo internal reflection plurality of times so as to be emitted toward a front of said lamp, wherein said translucent member is comprised of:

a pillar-shaped portion extending in a longitudinal direction of said lamp;

condenser lens portion at a rear-end of said pillar-shaped portion, said condenser lens portion allowing light from said LED light source to enter into said pillar-shaped portion allowing light from said LED light source into parallel light fluxes that travel toward said front of said lamp; and at least one parallel translation controlling portion translating a light path of said parallel light fluxes reaching said pillar-shaped portion to form a crank configuration in a direction in which said light path separates from said axis; and wherein;

said parallel translation controlling portion has a conical-configured inner peripheral surface and a conical-configured outer peripheral surface.

2. The vehicular lamp according to claim 1, wherein said parallel translation controlling portion is formed in substantially bowl-shape so as to surround said axis of said pillar-shaped portion.

3. The vehicular lamp according to claim 1, further comprising at least one diffusing lens element formed on a front-end of said parallel translation controlling portion, said at least one diffusing lens element allowing said parallel light fluxes reaching said front-end of said parallel translation controlling portion to be emitted diffusely toward said front of said lamp.

4. The vehicular lamp according to claim 1, said front-end of said pillar-shaped portion is provided with a light-emitting face that allows said parallel light fluxes reaching said front-end to be emitted toward said front of said lamp.

5. The vehicular lamp according to claim 1, wherein said LED light source and said translucent member form a set, and said set of said LED light source and translucent member is provided at a plurality of locations.

6. The vehicular lamp according to claim 2, further comprising at least one diffusing lens element formed on a front-end of said parallel translation controlling portion, said at least one diffusing lens element allowing said parallel light fluxes reaching said front-end of said parallel translation controlling portion to be emitted diffusely toward said front of said lamp.

7. The vehicular lamp according to claim 6, said front-end of said pillar-shaped portion is provided with a light-emitting face that allows said parallel light fluxes reaching said front-end to be emitted toward said front of said lamp.

8. The vehicular lamp according to claim 7, wherein said LED light source and said translucent member form a set, and said set of said LED light source and translucent member is provided at a plurality of locations.

9. The vehicular lamp according to claim 2, said front-end of said pillar-shaped portion is provided with a light-emitting face that allows said parallel light fluxes reaching said front-end to be emitted toward said front of said lamp.

10. The vehicular lamp according to claim 9, wherein said LED light source and said translucent member form a set, and said set of said LED light source and translucent member is provided at a plurality of locations.

11. The vehicular lamp according to claim 3, said front-end of said pillar-shaped portion is provided with a light-emitting face that allows said parallel light fluxes reaching said front-end to be emitted toward said front of said lamp.

12. The vehicular lamp according to claim 11, wherein said LED light source and said translucent member form a set, and said set of said LED light source and translucent member is provided at a plurality of locations.

* * * * *